US005220906A

United States Patent [19]

Choma

[11] Patent Number: 5,220,906

[45] Date of Patent: Jun. 22, 1993

[54] DEVICE TO DRAW THE BOWSTRING OF A CROSSBOW

[75] Inventor: David A. Choma, Akron, Ohio

[73] Assignee: Horton Manufacturing Company Inc., Stow, Ohio

[21] Appl. No.: 638,621

[22] Filed: Jan. 8, 1991

[51] Int. Cl.[5] ..... F41B 5/12

[52] U.S. Cl. ..... 124/25; 124/86; 254/236; 74/89.15

[58] Field of Search ..... 124/25, 90, 88, 86, 124/23.1, 25.6; 254/231, 236; 74/89.15

[56] References Cited

U.S. PATENT DOCUMENTS

| | | | |
|---|---|---|---|
| 2,786,461 | 3/1957 | Pelsue, Jr. | 124/25 |
| 3,043,287 | 7/1962 | Nelson | 124/25 |
| 3,176,962 | 4/1965 | Baker | 254/236 |
| 3,670,711 | 6/1972 | Firestone | 124/25 |
| 4,258,689 | 3/1981 | Barnett | 124/25 |
| 4,719,897 | 1/1988 | Gaudreau | 124/25 |
| 4,841,790 | 6/1989 | Williston et al. | 74/89.15 |
| 4,901,775 | 2/1990 | Scott et al. | 254/231 X |
| 5,086,900 | 2/1992 | Kikuta et al. | 74/89.15 X |

OTHER PUBLICATIONS

Barnett International, Inc., P.O. Box 934, Odessa, Fla. 33556; "Barnett Crossbows" 1991 catalog, p. 7.

Pro Line Company, 1675 Gun Lake Road, Hastings, Mich. 49058; 4 page brochure; 1988.

San Marino, Archery Sport s.r.l., 1-25080 Soiano del Lago, Italy; 2 pages of catalog; date unknown.

Saxon International, Inc., 615 Jasmine Avenue N., Tarpon Springs, Fla. 34689; p. 14 of 1990 catalog.

*Primary Examiner*—Peter M. Cuomo

*Attorney, Agent, or Firm*—Renner, Kenner, Greive, Bobak, Taylor & Weber

[57] ABSTRACT

A device for cocking a crossbow having a bow (12) and a bowstring (16) includes a main housing (21), a movable shaft (22), a device (31) operatively connected to the movable shaft (22) to laterally move the movable shaft (22), and a back element (70) mounted on the movable shaft (22) to engage the bowstring (16), such that when the movable shaft (22) moves, the bowstring (16) is drawn.

10 Claims, 3 Drawing Sheets

DEVICE TO DRAW THE BOWSTRING OF A CROSSBOW

TECHNICAL FIELD

The present invention generally relates to a device to draw the bowstring of a crossbow. More particularly, the present invention relates to a device which is preferably demountably securable to a crossbow and which includes a movable shaft which will engage and draw the bowstring as the shaft moves. Specifically, the present invention relates to a device, as above, wherein the movement of the shaft is effected by a selectively operable electric motor.

BACKGROUND ART

Conventional archery devices usually include a bow having two arms with a bowstring strung between the ends of the arms. The user grasps the bow and "draws" the bowstring with one hand while pushing the bow itself with the other hand. The term "drawing" in both crossbow and conventional archery technology can refer to moving the bowstring into a position to fire an arrow, and is applicable to a pushing as well as a pulling movement of the bowstring.

Drawing the bowstring tends to cause the arms to want move toward each other, creating tension therebetween. The amount of force necessary to draw a given bow is usually measured in pounds and is known as the "draw weight" of the bow. When the bowstring is released, energy is transferred through the bowstring and to the arrow which is propelled or "fired" toward a target.

One method of increasing the speed at which an arrow is propelled is to increase the stiffness of the bow arms. However, the user must be able to draw the bowstring. Thus, increasing the stiffness of the bow arms to create a very high draw weight bow may be useless if the user cannot draw it and hold the bow in the drawn position for a sufficient period of time to aim at the target. If the user is struggling with holding the bow string in the drawn position, his aim will be deleteriously affected.

Crossbow technology was developed to relieve the tension applied to the user's arms as encountered when using a conventional bow as discussed hereinabove. The stock of the crossbow holds the bowstring in the drawn position, allowing the user to aim without concern for manually holding and maintaining the draw weight. This technology has given rise to modern crossbows having draw weights of 150 pounds or more.

Trigger mechanisms, as known in the art, were developed in order to both hold the bow string in the drawn position, and to release the bowstring when the trigger is operated. Often, a bowstring catch is provided which holds the bowstring until the trigger is manipulated, which in turn rotates or otherwise moves a sear, releasing the bowstring catch and hence, the bowstring itself. When the bowstring is drawn and held in the drawn position by the trigger mechanism, the crossbow is said to be "cocked".

In order to draw the bowstring and cock the crossbow, the user must be strong enough to draw the full draw weight of the bow. Devices have been incorporated into crossbows to make this operation easier for the user. For example, it is known to provide a stirrup bracket mounted on one end of a crossbow. The user places the stirrup bracket onto the ground and places a foot into the bracket. By applying the user's body weight to the grounded bracket, the user can then pull back or "draw" the bowstring. For a crossbow having a very high draw weight, and for users having less strength than some others might have, this operation often proves difficult.

Manual crank winch devices are known to draw the bowstring of a crossbow. These devices are often cumbersome to connect and disconnect from the crossbow with each use. Moreover, they are usually large and difficult to use taking more time and effort than it is worth. Therefore, a need exists for a device which will draw the bowstring of a crossbow, which is easily connected to the crossbow, and which is simple to operate.

DISCLOSURE OF THE INVENTION

It is therefore a primary object of the present invention to provide a device which will draw the bowstring of a crossbow.

It is another object of the present invention to provide a device, as above, which is easily connected to the crossbow.

It is a further object of the present invention to provide a device, as above, which is also easily disconnected from the crossbow.

It is an additional object of the present invention to provide a device, as above, which is easily manipulated and operated by the user thereof.

These and other objects of the present invention, as well as the advantages thereof over existing prior art forms, which will become apparent from the description to follow, are accomplished by the means hereinafter described and claimed.

In general, a device for cocking a crossbow having a bow and a bowstring includes a housing and a shaft movable laterally with respect to the housing. The housing carries means operatively connected to the shaft to laterally move the shaft. The shaft carries means to engage the bowstring such that when the shaft moves, the bowstring is drawn.

A preferred exemplary device to draw the bowstring of a crossbow incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
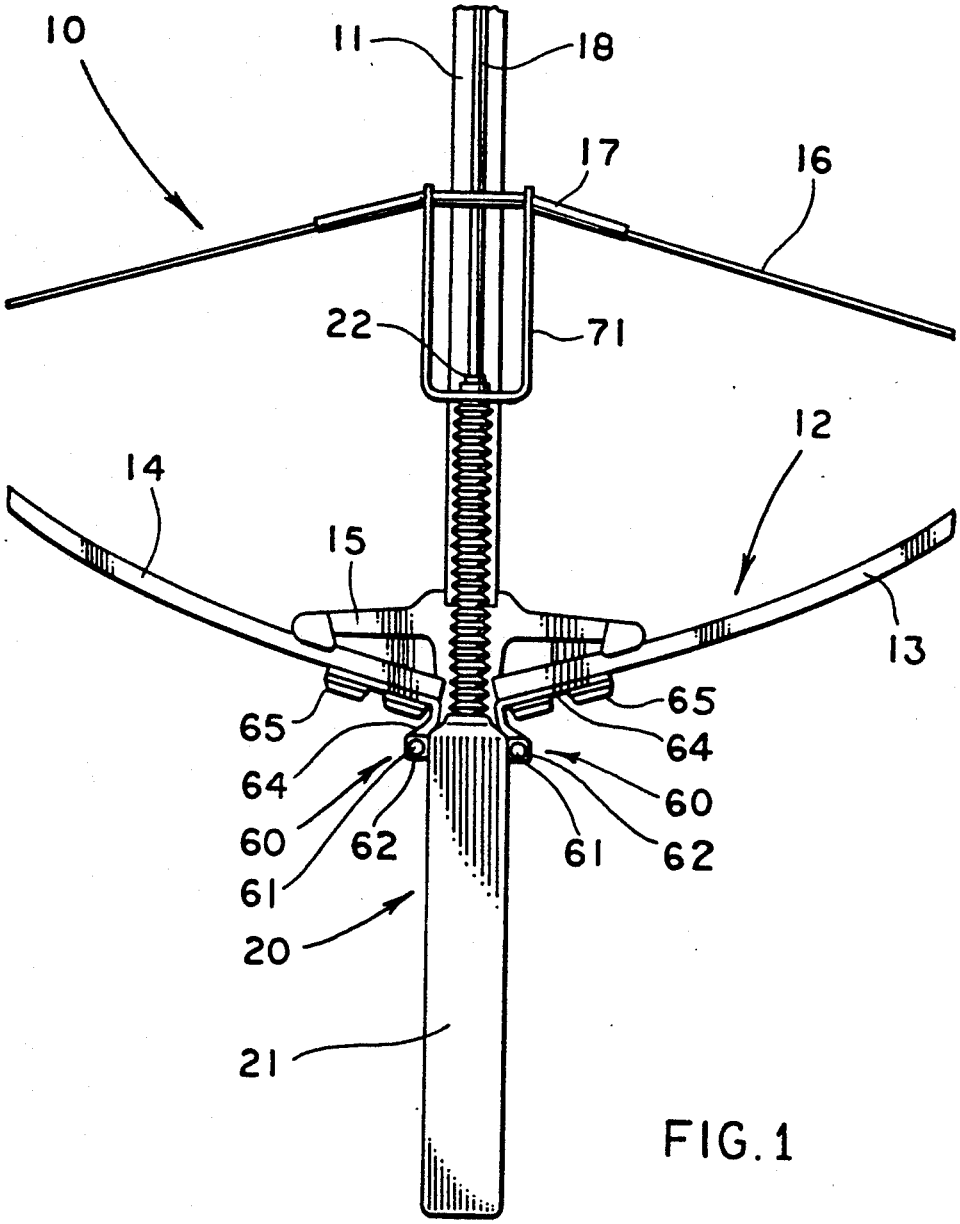
FIG. 1 is a broken away top plan view of a device according to the present invention shown mounted upon a crossbow.

A crossbow forming the environment for the present invention is generally indicated by the numeral 10 in FIG. 1. Since crossbows are well known in the art, a complete drawing of a crossbow is not contained in the drawings. Thus, crossbow 10, as shown includes a forestock 11 and a bow generally indicated by the numeral 12. Bow 12 includes bow arms 13 and 14 and a bow bracket 15 is provided, as is known in the art, to mount bow 12 onto forestock 11. A bowstring 16 is strung between the ends (not shown) of bow arms 13 and 14. A wrap 17 is often provided in the area where bowstring 16 engages an arrow (not shown) to prevent bowstring 16 from fraying with repeated use. When bowstring 16 is drawn and crossbow 10 cocked, bowstring 16 is caused to move in a direction generally away from bow bracket 15 (upward in FIG. 1) and toward a trigger mechanism. As stated above, trigger mechanisms and their operation are known in the art, and all operate by having the bowstring dran toward them and retained thereby until activated to fire the crossbow. It should be evident that the present invention is operable with any such trigger mechanism. In order to guide an arrow when the crossbow 10 is fired, forestock 11 is normally provided with a barrel groove 18.

A device according to a preferred embodiment of the invention for drawing bowstring 16 is generally indicated by the numeral 20 on the attached drawings. Device 20 includes a main housing 21 and a shaft generally indicated by the numeral 22. As will be more fully appreciated from the discussion to follow, shaft 22 is selectively laterally movable into an extended position and into a retracted position with respect to main housing 21. The portion of shaft 22 which extends out of housing 21 may be covered with an expandable accordion-like covering such as a ribbed covering 23, which is useful for preventing moisture, debris and the like from entering main housing 21 and also protects the hands of the user should accidental contact be made with shaft 22 during operation.

Figure 2:
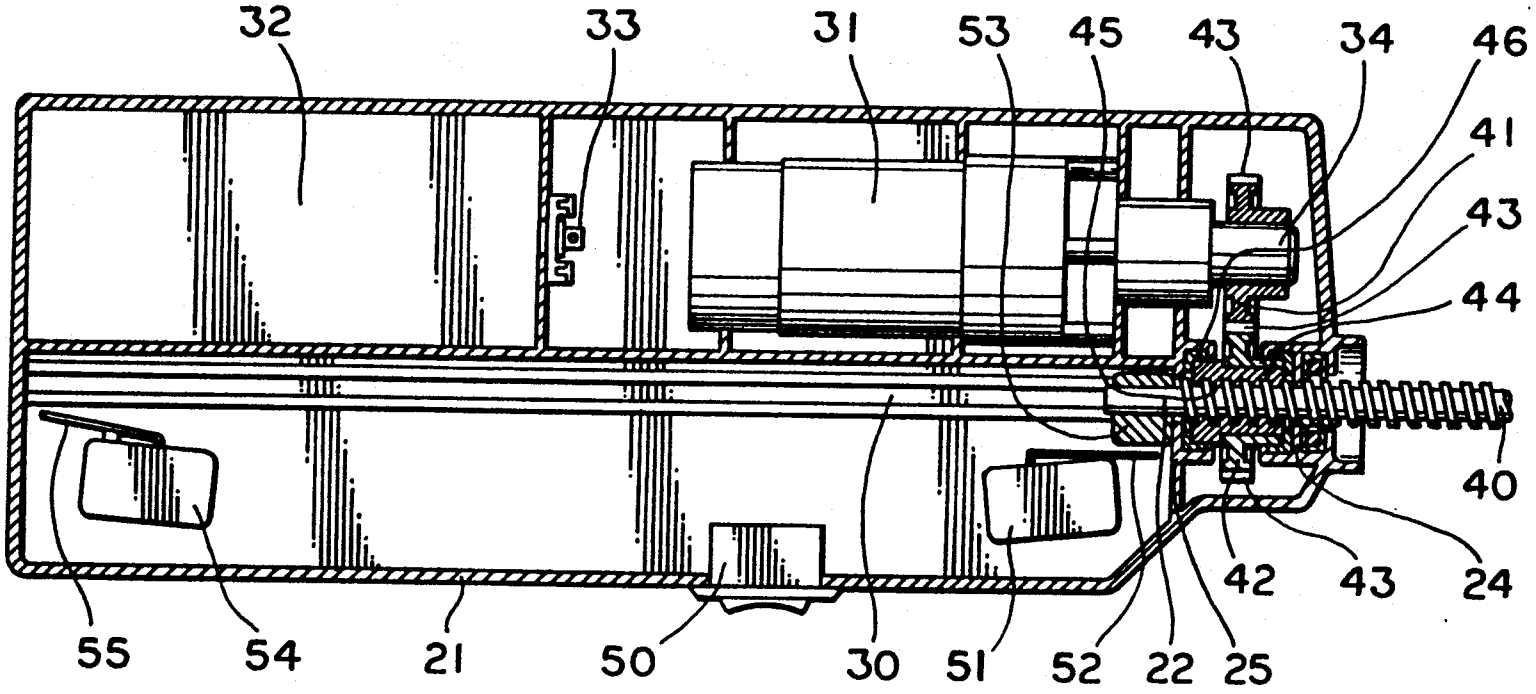
FIG. 2 is a broken away side elevational view of a preferred device to draw the bowstring of a crossbow according to the present invention.

FIG. 1 shows shaft 22 in a partially extended position at some point between the fully extended and the fully retracted position. The actual length of the fully extended position will be dependent upon the length of the crossbow itself, and is not a limitation of the invention. As best shown in FIG. 2, shaft 22 is held in alignment within main housing by shaft support walls 24 and 25, with its movement being guided by a guide track 30 in housing 21.

In order to effect movement of shaft 22, it is preferable to employ an electric motor 31 connected to a battery power source 32. The connection between electric motor 31 and battery 32 may be in the form of electrical wiring or the like (not shown) extending from a terminal 33 on battery 32 to motor 31. Those skilled in the art will appreciate from the discussion contained herein, that shaft 22 may be moved by means other than an electric motor, such as by hydraulic pressure or the like, all of which are within the scope of the invention. Electric motor 31 operates to rotate a motor shaft 34 which moves shaft 22 in a manner now to be described.

In a preferred form of the invention, at least a portion of shaft 22 is provided with screw threads 40, as shown in FIG. 2. A first gear 41 and a second gear 42 are provided forming a gear set to operatively connect electric motor 31 to shaft 22 and to translate rotational motion of motor shaft 34 into rectilinear movement of shaft 22. First gear 41 is rigidly connected, such as by a press fit, adhesive bonding or any such means, to motor shaft 34, such that the rotation of motor shaft 34 causes first gear 41 to also rotate. First gear 41 and second gear 42 are preferably spur gears such that they are interactively connected by a plurality of teeth elements 43 on both first and second gears 41 and 42, as is known in the art. Thus, as first gear 41 rotates, second gear 42 is also caused to rotate.

Second gear 42 is rigidly connected by any suitable means to a worm sleeve member 44, having internal threads 45 mating to screw threads 40 of shaft 22 internally of worm sleeve member 44. Worm sleeve member 44 is rotatably mounted within main housing 21, such that it is free to rotate but prevented from moving laterally such as by sleeve mount walls 46. Worm sleeve member 44 rotates as second gear 42 rotates, and because worm sleeve member 44 is laterally restricted from moving, screw threads 40 rotate therein and thus, cause shaft 22 to move laterally within worm sleeve member 44. Therefore, shaft 22 is caused to move laterally within main housing 21 and along guide track 30 as well as laterally outside of housing 21 toward the trigger mechanism. It will be appreciated that shaft 22 may be laterally moved by means other than screw threads 40, worm sleeve member 44 and first and second gears 41 and 42, and still be within the scope of the invention. For example, a single gear may be employed or shaft 22 may be directly connected to electric motor 31, all such embodiments being within the scope of the invention.

It is also preferred that electric motor 31 be reversibly operable such that worm sleeve member 44 can be caused to rotate in either direction, thus causing shaft 22 to either extend from main housing 21 or retract into main housing 21. An on/off/reverse switch 50 may be provided and electrically connected (not shown) to motor 31 to cause electric motor 31 to operate to extend or retract shaft 22. Retraction of shaft 22 could also be accomplished by means other than a reversing of electric motor 31. For example, shaft 22 may be caused to be disengaged from worm sleeve member 44 and to retractably slide within guide track 30.

To automatically control shaft 22, it is preferred that a first limit switch 51 be provided having a contact extension 52, to engage a sensor contact element 53 on shaft 22. By mounting limit switch 51 in a predetermined location within main housing 21 and relative to guide track 30, the extension of shaft 22 may thus be controlled. When the predetermined length is achieved, that is, when shaft 22 has extended to a length sufficient to cock crossbow 10, sensor contact element 53 engages contact extension 52, causing limit switch 51 to stop lateral movement of shaft 22 such as by breaking the circuit between battery 32 and electric motor 31. Similarly, a second limit switch 54 may be provided having a second contact extension 55, and mounted within main housing 21 such that the lateral degree to which shaft 22 is retractable within main housing 21 is similarly controlled. When the desired and predetermined point is reached, sensor contact element 53 engages second contact extension 55 stopping lateral movement of shaft 22.

A wall, such as support wall 25, may also be used to prevent shaft 22 from being completely removed from main housing 21. Sensor contact element 53 will engage support wall 25, and because shaft 22 is rigidly affixed to sensor contact element 53, shaft 22 is prevented from being completely removed from main housing 21.

As shaft 22 is caused to laterally extend from main housing 22, it is adapted to contact bowstring 16, such that bowstring 16 is drawn. It will be appreciated by one skilled in the art, that device 20 may be positioned on either side of bow 12 such that shaft 22 would operate to pull bowstring 16 rather than pushing it in order to draw bowstring 16 and cock crossbow 10. Moreover, as will be hereinafter described, while it is preferred to temporarily affix device 20 to crossbow 10 during the cocking operation, device 20 may be permanently attached to forestock 11 or some other portion of crossbow 10 without departing from the spirit of this invention.

Figure 4:
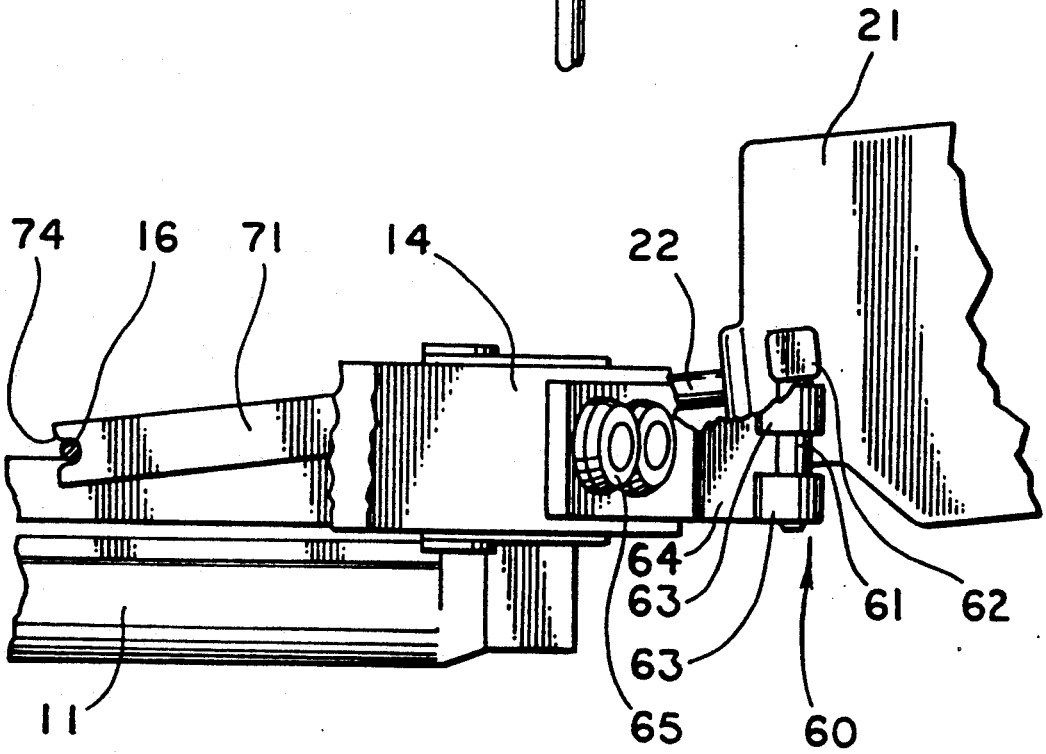
FIG. 4 is an enlarged, broken away side perspective view of a portion of the device of FIG. 1, showing the detail of a preferred mounting bracket assembly.

However, in a preferred embodiment of the invention, and as depicted in the drawings, device 20 is removably securable to forestock 11, such that bow 12 is generally positioned between device 20 and bowstring 16. In order to removably secure device 20 to crossbow 10, a bolt and eye bracket generally indicated by the numeral 60, best shown in FIG. 4, may be employed. A bolt 61 may be secured to main housing 21 such as by being carried by a bracket 62 rigidly affixed to main housing 21 or integrally formed therewith. At least one and preferably two eye rings 63 are carried by crossbow 10 such as by being attached to an angled bracket plate 64 which is itself rigidly affixed to bow 12 such as by lock screws 65. To mount device 20 to crossbow 10, bolt 61 is merely slipped into eye rings 63 and, of course, to remove device 20 from crossbow 10 bolt 61 is removed from eye rings 63. Preferably, main housing 21 is provided with two sets of eye rings 63 and bolts 61, and first arm 13 and second arm 14 are both fitted with similar angled bracket plates 64, as best shown in FIG. 1.

Figure 3:
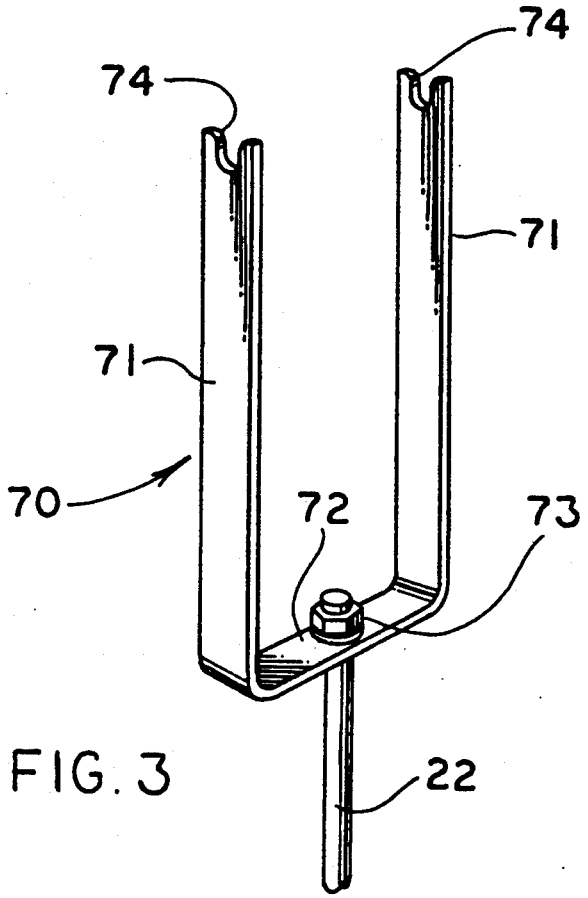
FIG. 3 is a side broken away perspective view of a fork element used in the present invention to engage a bowstring.

As shaft 22 is extended from main housing 21, as described above, it is designed to contact and draw bowstring 16. It is useful to provide shaft 22 with an end that will facilitate engagement between itself and bowstring 16. A preferred structure is a fork generally indicated by the numeral 70 in FIG. 3. Fork 70 is preferably provided with two opposing tine elements 71 laterally spaced by a crossbar 72. Fork 70 is affixed to shaft 22 such as by nut 73. In order to securely engage bowstring 16, tine elements 71 are provided with notches 74 to engage and trap bowstring 16 as shaft 22 is moved laterally.

It should thus be evident that a device as disclosed herein can be employed to draw the bowstring of a crossbow. Thus the invention disclosed herein and defined by the following claims accomplishes the objects of the present invention and otherwise constitutes an advantageous contribution to the art.

I claim:

1. A device for cocking a crossbow having a bowstring, the device comprising a housing, a shaft rectilinearly movable with respect to said housing, means within said housing operatively connected to said shaft to rectilinearly move said shaft, said means operatively connected to said shaft including screw threads on said shaft, a gear set and worm sleeve engageable with said screw threads, and electric motor means having a rotatable shaft, such that rotational motion of said motor shaft is translated into rectilinear movement of said shaft relative to said housing, and means carried by said shaft to engage the bowstring, such that when said shaft moves, the bowstring is drawn, said means to engage the bowstring including a fork element having a plurality of tine members separated by a crossbar.

2. A device as in claim 1, further comprising limit switch control means to control movement of said shaft beyond a predetermined point.

3. A device as in claim 1, wherein said electric motor is selectively and reversibly operable such that said shaft is extensibly movable and retractably movable in relation to said housing.

4. A device as in claim 1, wherein said worm sleeve is provided with screw threads matable to said screw threads of said shaft, such that rotation of said worm sleeve causes lateral movement of said shaft.

5. A device as in claim 1, wherein said crossbar is affixed to one end of said shaft.

6. A device as in claim 1, wherein each of said tine elements have a notch in one end thereof to engage the bowstring.

7. A device as in claim 1, further comprising securing means to removably mount the device to the crossbow.

8. A device as in claim 7, wherein said securing means includes at least one eye ring affixed to the crossbow, and a bolt affixed to said housing, such that to removably mount the device to the crossbow, said bolt is caused to engage said eye ring.

9. A device for cocking a crossbow having bowstring, the device comprising a housing, a shaft rectilinearly movable with respect to said housing, means within said housing operatively connected to said shaft to rectilinearly move said shaft, said means operatively connected to said shaft including screw threads on said shaft, a gear set and worm sleeve engageable with said screw threads, and electric motor means having a rotatable shaft, such that rotational motion is said motor shaft is translated into rectilinear movement of said shaft relative to said housing, means carried by said shaft to engage the bowstring, such that when said shaft moves, the bowstring is drawn, and securing means to removal by mount the device to the crossbow.

10. A device as in claim 9, wherein said securing means includes at least one eye ring affixed to the crossbow, and a bolt affixed to said housing, such that a to removably mount the device to the crossbow, said bolt is caused to engage said eye ring.

* * * * *